US007096510B2

(12) United States Patent
Yeadon

(10) Patent No.: US 7,096,510 B2
(45) Date of Patent: Aug. 29, 2006

(54) HEAD COVERING WITH HAIR RETAINING POUCH

(75) Inventor: Mary Beth Yeadon, Iron River, MI (US)

(73) Assignee: Roaring Eagle,Inc., Iron River, MI (US)

( * ) Notice: Subject to any disclaimer, the term of this patent is extended or adjusted under 35 U.S.C. 154(b) by 0 days.

(21) Appl. No.: 10/916,906

(22) Filed: Aug. 11, 2004

(65) Prior Publication Data

US 2006/0048277 A1 Mar. 9, 2006

(51) Int. Cl.
*A42B 1/04* (2006.01)

(52) U.S. Cl. ..... 2/202; 2/207

(58) Field of Classification Search ..... 2/207, 2/202

See application file for complete search history.

(56) References Cited

U.S. PATENT DOCUMENTS

| | | | | |
|---|---|---|---|---|
| 127,918 | A | | 6/1872 | Pansow |
| 1,519,016 | A | | 7/1924 | Bellitz |
| 1,504,100 | A | | 8/1924 | Danubio |
| 1,516,796 | A | | 11/1924 | Seilaz |
| 1,870,298 | A | | 8/1932 | Stone |
| 1,920,387 | A | * | 8/1933 | Harper ..... 2/68 |
| 2,106,056 | A | | 1/1938 | McCown |
| 2,211,184 | A | | 8/1940 | Varell |
| 2,469,250 | A | | 5/1949 | Schrenk |
| 2,519,512 | A | | 8/1950 | Stone |
| 2,730,722 | A | * | 1/1956 | Colangelo ..... 2/202 |
| 2,817,090 | A | | 12/1957 | Toellner |
| 2,864,383 | A | | 12/1958 | Jacks et al. |
| 3,746,016 | A | | 7/1973 | Goodman |
| 3,750,681 | A | | 8/1973 | Claunch |
| 4,378,667 | A | | 4/1983 | Velarde, Jr. |
| 5,048,128 | A | * | 9/1991 | Watson, Jr. ..... 2/204 |
| 5,174,312 | A | | 12/1992 | Adams |
| 5,186,186 | A | | 2/1993 | Hamilton |
| 5,472,003 | A | | 12/1995 | Frame et al. |
| 5,542,127 | A | * | 8/1996 | Bezanis ..... 2/172 |
| 5,590,422 | A | | 1/1997 | Henderson |
| 5,594,956 | A | | 1/1997 | Barrientos |
| 5,595,199 | A | | 1/1997 | Solomon et al. |
| 5,598,585 | A | | 2/1997 | Stroup |
| 5,621,919 | A | | 4/1997 | Graham |
| 5,727,575 | A | | 3/1998 | Rontal |
| 5,730,161 | A | | 3/1998 | Kohanek |
| 5,732,720 | A | | 3/1998 | Sears |
| 5,787,904 | A | | 8/1998 | Michaud |
| 5,799,334 | A | | 9/1998 | Griffith et al. |
| 5,799,672 | A | | 9/1998 | Hansbury |
| 5,826,593 | A | | 10/1998 | Haubrich |
| 5,875,488 | A | | 3/1999 | Milani |
| 5,878,756 | A | | 3/1999 | Bilodeau |

(Continued)

*Primary Examiner*—Katherine M. Moran

(57) ABSTRACT

A head covering commonly known as a skull cap in which the 'tail' extending from the back of the neck is fashioned into a pouch with an elasticized opening. The user styles his/her long hair with a ponytail, applies and secures the skullcap, and then inserts the ponytail hair into the 'tail' pouch. It may be worn under a helmet or hard hat. It has three functions. During windy outdoor activities or while riding in an open vehicle such as a motorcycle, boat, ATV, snowmobile, or convertible automobile, it contains the hair protecting it from the elements which soil the hair and from movement which tangles the hair. In an industrial environment, it effectively contains the hair to prevent free hair from falling forward and obstructing a worker's vision or entangling in machinery. Thirdly, in medical or food preparation industries, it contains the hair preventing contamination.

8 Claims, 3 Drawing Sheets

U.S. PATENT DOCUMENTS 5,920,909 A 7/1999 Ellsworth et al.
5,933,872 A 8/1999 Lema
5,970,991 A 10/1999 Srivastava
5,978,967 A 11/1999 Williams
6,014,776 A * 1/2000 DeVinzio ..... 2/207
6,076,532 A1 6/2002 Thomas et al.
6,401,255 B1 6/2002 Douglas
6,425,405 B1 7/2002 McRoberts
6,738,986 B1 * 5/2004 Martin ..... 2/207
2005/0034215 A1 * 2/2005 Harrison et al. ..... 2/207

* cited by examiner

HEAD COVERING WITH HAIR RETAINING POUCH

BACKGROUND OF THE INVENTION

The present invention relates to apparel which are coverings for the head. Specifically this device has a flap over the neck which features a pouch for retaining hair.

Skullcap-type head coverings are common in prior art. Examples are U.S. Pat. Nos. 2,469,250; 1,504,100; 1,516,796; 1,519,016; 1,870,298; 2,106,056; 2,817,090; 2,519,512; 6,014,776; and 5,594,956. These skull caps are snug fitting, comfortable and cover short hair, however do not retain long hair.

Hair retaining devices are common in prior art. Examples of clips, barrettes, combs and ties are U.S. Pat. Nos. 5,787,904; 5,186,186; 5,732,720; 5,826,593; 5,174,312; 5,590,422; 5,799,672; and 2,864,383. These retain long hair in a ponytail style however; they do not contain hair upon the crown of the head nor the length of the ponytail hair. Also, they have rigid parts which when worn under a helmet or hard hat cause discomfort when pressed against the scalp.

Hair retaining devices for hair styled in a ponytail are of three types. Examples of sleeve-type coverings are U.S. Pat. Nos. 5,730,161; 5,970,991; and 5,472,003. Examples of wrap around-type coverings are U.S. Pat. Nos. 5,727,575; 6,425,405 B1; and 5,727,575. Examples of pouch or pocket-type coverings are U.S. Pat Nos. 4,378,667; 127,918; 3,746,016; and 5,595,199.

These contain all or most of the length of the ponytail hair. They may or may not cover hair on the crown of the head. Some rely upon rigid parts to secure the device to the hair which when worn under a helmet or hard hat cause discomfort when pressed against the scalp. Others use hook and loop closures in which hair can become entrapped in the hook portion.

Head covering for protecting hair are present in prior art. Examples are U.S. Pat. Nos. 5,621,919; 3,750,681; 2,211,184; 5,920,909; and 6,076,532. These may or may not cover the all of the hair as some are headband type leaving the crown exposed. Many are loose formed bouffant type with elasticized head engaging openings. Such are not snug fitting enough to secure the ponytail which with the user's movements and gravity tend to displace the cap and expose hair.

Some head coverings feature an opening for a ponytail to be pulled through. Examples are U.S. Pat. Nos. 5,875,488; 5,799,334; 5,598,585; 6,401,255 B1; and 5,933,872. These contain the hair on the crown of the head however; they allow the length of the ponytail hair to be free.

Some prior art have combined a head covering with some type of hair retaining feature. Examples are U.S. Pat. Nos. 5,978,967; D482,843; and 5,878,756. Two have either rigid parts or a bulky thick knot which cause discomfort when worn under a helmet or hard hat. The third has hook and loop closures which may entangle the hair and leaves the distal portion of the ponytail hair exposed.

SUMMARY OF THE INVENTION

This invention offers a method of retaining hair under a secure fitting, comfortable, and fashionable head covering with a pouch to contain long ponytail-styled hair encompassing it's entirety without the use of rigid barrettes, clips, combs, ties or hook and loop closures. The user styles his/her long hair with a ponytail, applies and secures the skullcap, and then inserts the ponytail hair into the 'tail' pouch. It may be worn under a helmet or hard hat. It has three functions. During windy outdoor activities or while riding in an open vehicle such as a motorcycle, boat, ATV, snowmobile, or convertible automobile, it contains the hair protecting it from the elements which soil the hair and from movement which tangles the hair. In an industrial environment, it effectively contains the hair to prevent free hair from falling forward, obstructing a worker's vision or entangling in machinery. Thirdly, in medical or food preparation industries, it contains the hair preventing contamination.

DESCRIPTION OF VIEWS OF DRAWINGS

DETAILED DESCRIPTION OF THE INVENTION

This invention is apparel likened to other items of clothing such as shirts and pants. Similarly it is made of a textile fabric or other flexible material having pieces cut with specific shapes sewn together with thread in an exact configuration that once joined forms a unit to be worn on the body.

To facilitate the understanding of the construction of this invention, the following terms known to the art of garment making are defined:

Seam: The thread stitched union of two exact fitting pieces of textile fabric.

Overcast stitching: Z shaped thread stitching on the cut edge and inner surface of a seam for the purpose of preventing fraying or tearing and strengthening a seam.

Topstitching: The affixing of a seam to its larger unit by thread stitching near the seam's edge and through the top or outer surface for the purpose of stabilizing or strengthening a seam.

Hem: The once or twice turning over of a small fold at a straight cut edge and stitching said fold for the purpose of encasement of the cut edge and prevention of fraying or tearing.

Facing: The adjoining on one or more sides and then turning over of a fitted strip of fabric to a curved cut edge for the purpose of encasement of the cut edge and prevention of fraying or tearing.

Dart: The folding of fabric orientated from the cut edge and directed toward the center of a cut piece and affixing by thread stitching an elongated triangle for the purpose of creating a dimensional shape that enables a snug fit over a rounded body part.

Gathering: The creation of a plurality of micro-folds using a pulled thread in a drawstring fashion and then affixing by thread stitching to another unfolded piece of fabric for the purpose of joining two pieces of unequal length or for blousing.

Elastic gathering: The creation of a plurality of micro-folds by attaching an elastic band either by encasement within a small hem or by stitching upon a stretched elastic band for the purpose of creating a snug fit in a wide opening which is capable of stretching to allow the passage of a body part. An example is the elastic gathered waistband of pants.

Head covering (FIGS. 1 & 2, 1) is comprised of a three sectioned hemispheric crown, a headband (FIGS. 1 & 2, 6), securing ties (FIGS. 1 & 2, 7) and a flap extending over the neck. The center section of the crown (FIGS. 1 & 2, 3) begins at the top of the head, continues over the crown to the back of the head and ends as a flap extending over the neck.

Figure 1:
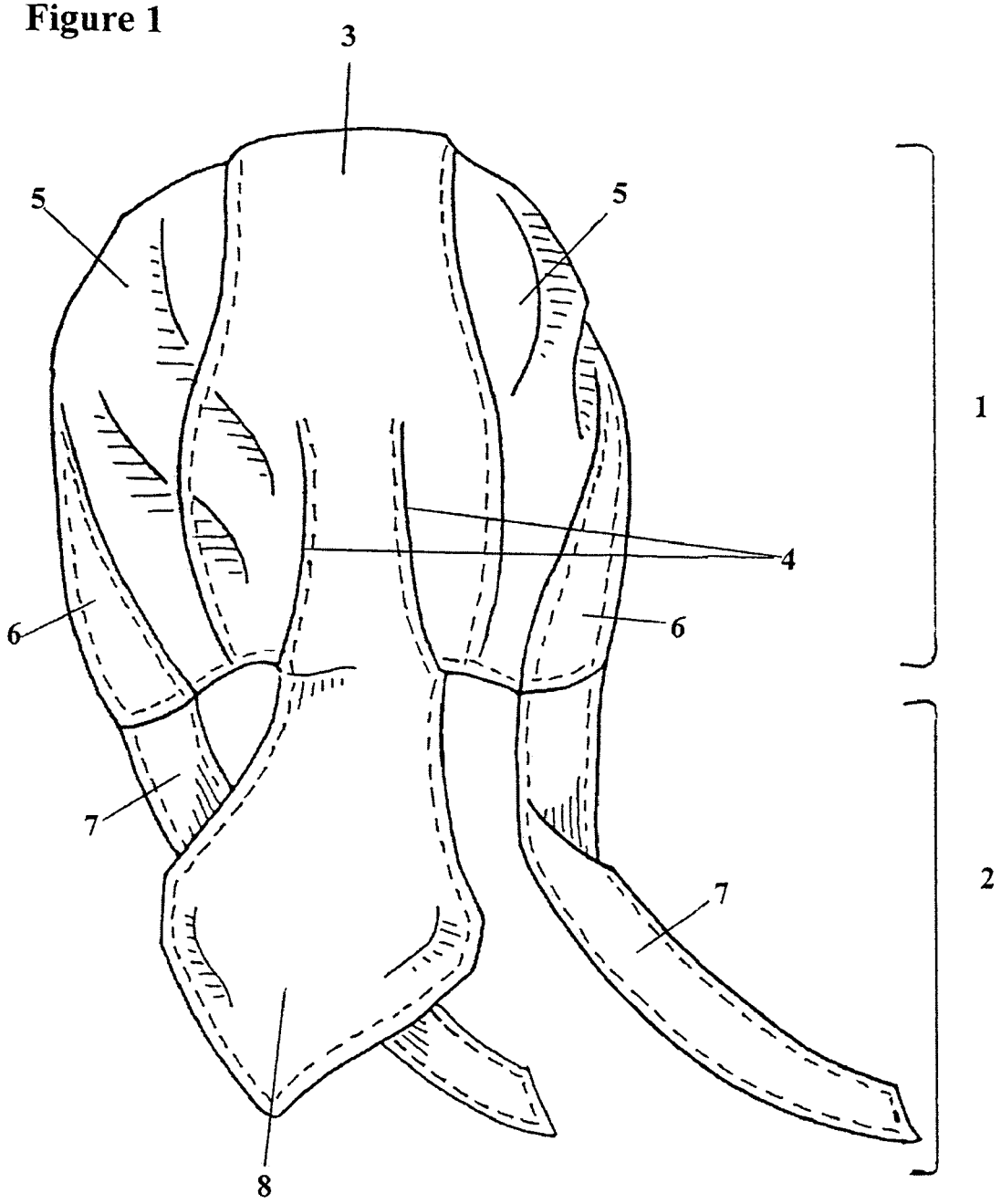
FIG. 1 is a rear view featuring the outer surface of the invention.
Figure 2:
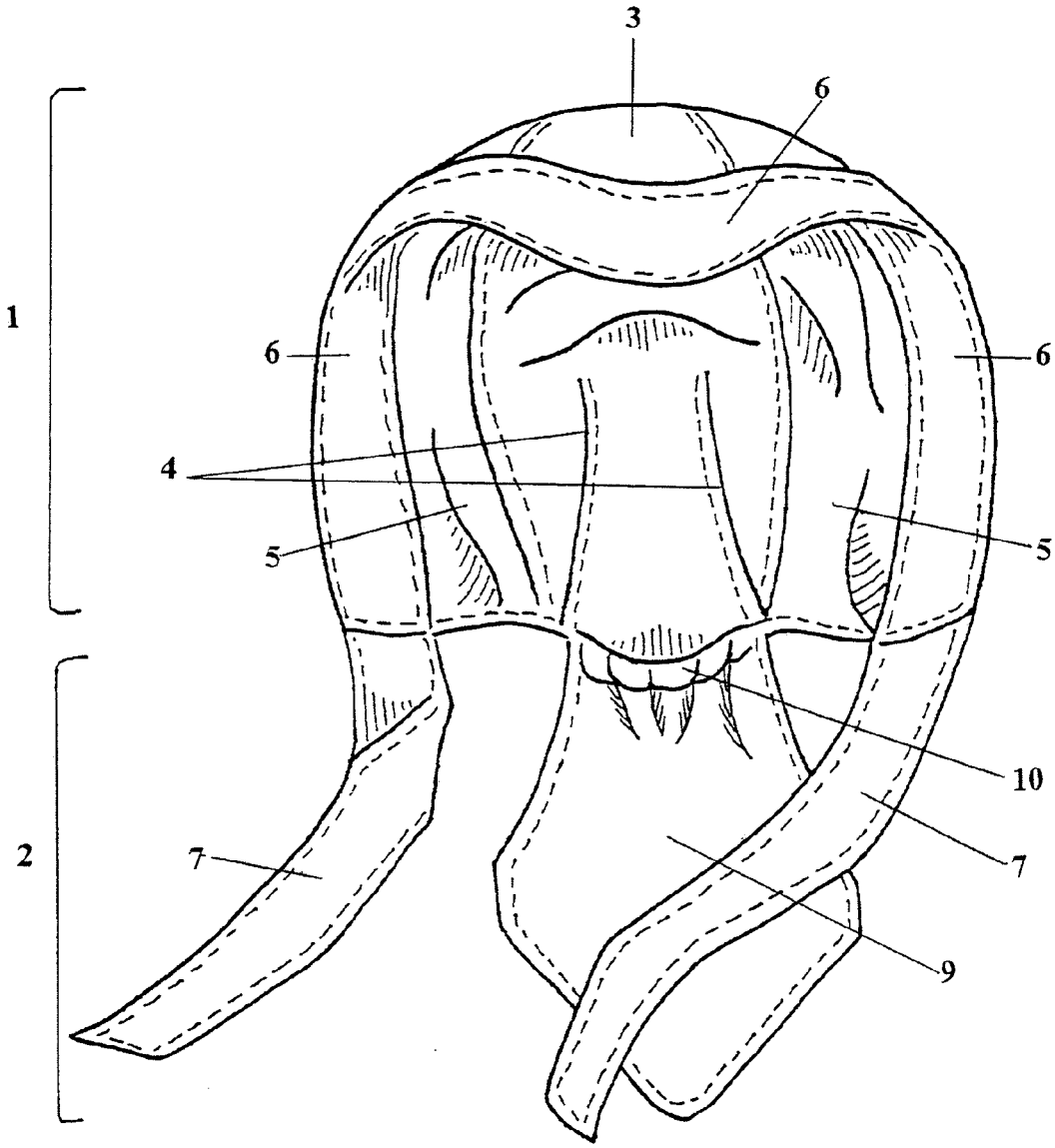
FIG. 2 is a front view featuring the inner surface of the invention.
Figure 3:
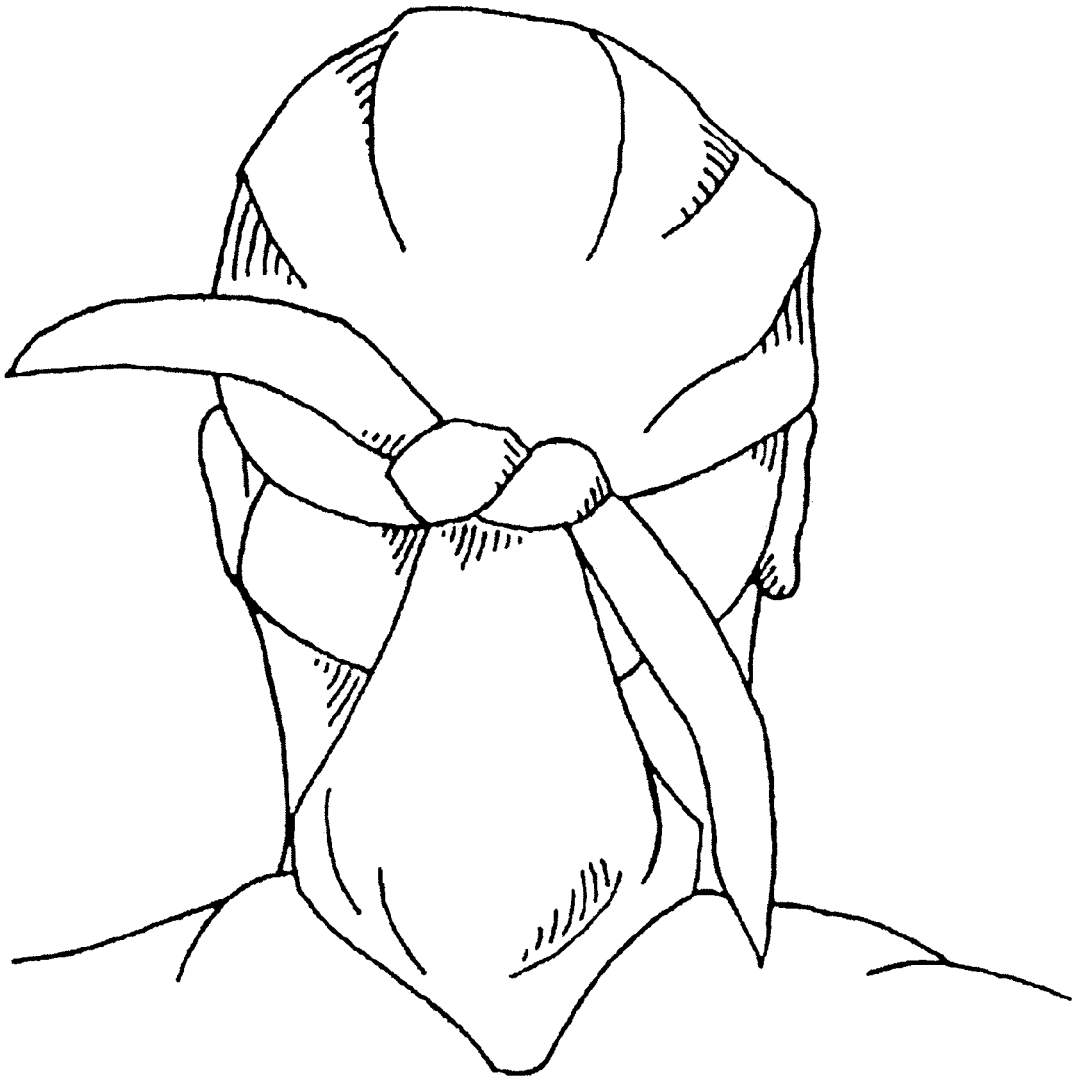
FIG. 3 is an embodied rear view featuring application upon a user's head.

To enhance a snug fit, it is specifically shaped and has two darts (FIGS. 1 & 2, 4). Its seams are overcast stitched and topstitched.

The crown of head covering (FIGS. 1 & 2, 1) has two side sections (FIGS. 1 & 2, 5) which are half-circle shaped and begin at the temple area, covers the side of the head and continue to near the base of the neck. Its seams are overcast stitched and topstitched. Its cut edge near the base of the neck together with a small segment of the center section (FIGS. 1 & 2, 3) is hemmed.

The crown of head covering (FIGS. 1 & 2, 1) is attached to a headband (FIGS. 1 & 2, 6). It has an elongated arc shape which enhances a snug fit. It extends from behind the ear, around the far side of the face and temples, across the forehead and continues similarly to the other ear. It is adjoined to the open edge of the three sectioned crown. It is faced on its inner surface (FIG. 2, 6) with a different fabric having sweat absorbing properties and then topstitched.

The headband (FIGS. 1 & 2, 6) of head covering (FIGS. 1 & 2, 1) is attached to two securing ties (FIGS. 1 & 2, 7). They have an elongated arc shape which enhances a snug fit. They are stitched to the ends of the headband (FIGS. 1 & 2, 6) located behind the ears. They are faced and topstitched.

The hair retainer portion (FIGS. 1 & 2, 2) has two walls. The outer wall (FIG. 1, 8) is the flap extension of center section of the crown (FIGS. 1 & 2, 3) located at the base of the neck. It is an elongated shape. It functions as one of two sides of a pouch for containing ponytail styled hair.

The hair retainer outer wall (FIG. 1, 8) is attached to its inner wall (FIG. 2, 9). Its shape is similar to the outer wall (FIG. 1, 8) but is wider and shorter to allow for expansion to accommodate the ponytail hair which has depth. The two walls are thread stitched together on three sides having the fourth side open at the base of the neck. It is then topstitched. A hollow cavity or pouch is created.

The fourth side of the inner wall (FIG. 2, 9) has an elastic gathered opening (FIG. 2, 10) of a concave shape. It functions to draw in the extra width of the inner wall to create a snug fit about the ponytail hair and more effectively retain it The method of application is:

The user styles his/her long hair into a ponytail positioned at the base of the neck.

The skull cap is applied to the head.

The skull cap is secured to the head by tying the ties.

The retainer is folded upward and away from the ponytail.

The ponytail hair is twisted until a firm folded over bun-like bundle of hair is formed.

The retainer is dropped down to its suspended position.

The user stretches the elasticized opening of the inner wall of the retainer and inserts the bundle of hair into the pouch cavity.

The bundle of hair within the retainer is allowed to loosen for the user's comfort.

The invention claimed is:

1. Method of wearing a head covering with hair retaining pouch during windy outdoor activities or in an industrial environment or in the medical or the food preparation industries comprising the steps of:

A) Providing a head covering, wherein said head covering comprises a) a three sectioned crown, wherein the three sectioned crown comprises a (i) center section which begins at the forehead, continues over the crown and back of the head and extends in a flap at the base of the neck and (ii) two side half circle shaped sections extending from the temple to lateral of the base of the neck;

wherein said two side half circle shaped sections are stitched to the center section; and wherein said three sectioned crown functions as the head engaging portion of the head covering;

b) a headband of an elongated arc shape, wherein said headband is faced with an inner surface of a different textile fabric with sweat absorbing properties, and wherein said headband is stitched to the three sectioned crown;

c) securing ties of an elongated arc shape, wherein said securing ties extend from the headband lateral to the base of the neck, wherein when said securing ties are lapped over the flap extending from the base of the neck and tied in a knot, said securing ties function to secure the head covering to the wearer's head; and d) a flap extending from the base of the neck; wherein said flap comprises a hair retaining pouch having an outer wall, an inner wall and an elasticized opening;

wherein the outer wall is in an elongated shape that extends from the head covering's center crown section located at the base of the neck;

wherein the inner wall is in an elongated shape similar to but wider and shorter than the outer wall extending from the base of the neck to the end of the outer wall and stitched on three sides;

wherein there is an elasticized opening of a concave shape on the upper edge of the inner wall;

wherein the elasticized opening is made by folding over the textile fabric or other flexible material and stitching to it an elastic band;

wherein the outer wall, inner wall and elasticized opening together form a hair retaining pouch into which a ponytail bundle of hair can be inserted and retained, wherein said head covering does not require the use of rigid barrettes, clips, combs, ties or hook and loop closures;

B) styling the user's hair into a ponytail, centered at the base of the neck;

C) applying the head covering to the user's head;

D) securing the head covering to the user's head by tying the head covering's ties;

E) folding the hair retaining pouch portion of the head covering upward and away from the ponytail;

F) twisting the user's ponytail hair until a firm folded over bun-like bundle of hair is formed;

G) dropping down the hair retaining pouch to its suspended position;

H) stretching the elasticized opening of the inner wall of the hair retaining pouch to open it;

I) inserting said bundle of hair into the opening of the inner wall of the hair retaining pouch; and J) allowing the bundle of hair to loosen as desired for the user's comfort.

2. The method of claim 1 further comprising

K) placing a hat on top of the head covering, wherein said hat is selected from the group comprising a helmet and a hard hat.

3. The method of claim 2 wherein said hat is a helmet.

4. The method of claim 2 wherein said hat is a hard hat.

5. The method of claim 1 wherein the head covering is worn during windy outdoor activities.

6. The method of claim 1 wherein the head covering is worn in an industrial environment.

7. The method of claim 1 wherein the head covering is worn in the medical industries.

8. The method of claim 1 wherein the head covering is worn in the food preparation industries.

* * * * *